United States Patent [19]

Ikari et al.

[11] Patent Number: 4,984,956

[45] Date of Patent: Jan. 15, 1991

[54] APPARATUS FOR CONTROLLING SPEED OF WORKING MACHINE IN THE FORM OF A CONSTRUCTION MACHINE

[75] Inventors: Masanori Ikari, Sayama; Noboru Yajima, Kawagoe, both of Japan

[73] Assignee: Kabushiki Kaisha Komatsu Seisakusho, Tokyo, Japan

[21] Appl. No.: 295,725

[22] PCT Filed: Mar. 18, 1988

[86] PCT No.: PCT/JP88/00292

§ 371 Date: Nov. 17, 1988

§ 102(e) Date: Nov. 17, 1988

[87] PCT Pub. No.: WO88/07108

PCT Pub. Date: Sep. 22, 1988

[30] Foreign Application Priority Data

Mar. 19, 1987 [JP] Japan ..... 62-62543
May 26, 1987 [JP] Japan ..... 62-126884

[51] Int. Cl.[5] ..... E02F 3/00
[52] U.S. Cl. ..... 414/699; 414/718
[58] Field of Search ..... 414/685, 699, 700, 701, 414/708, 718; 91/508

[56] References Cited

U.S. PATENT DOCUMENTS 3,726,428 4/1973 Lark et al. ..... 414/700

*Primary Examiner*—Robert J. Spar
*Assistant Examiner*—Donald W. Underwood
*Attorney, Agent, or Firm*—Diller, Ramik & Wight

[57] ABSTRACT

The present invention is concerned with a working machine in the form of a construction machine including booms 2 and a bucket 4 such as a wheel loader, a shovel loader or the like. When a scooping operation is performed by alternately repeating a tilting operation with the use of only a bucket operation lever 16 while a boom operation lever 15 is held at a boom kick-out position, a lifting operation for the booms 2 and a tilting operation for the bucket 4 while the boom operation lever 15 is shifted to a neutral position, a lift speed of the booms 2 is variably controlled to a speed corresponding to a tile speed of the bucket or an angle of the booms whereby the tilt speed is harmonized with the boom speed.

8 Claims, 13 Drawing Sheets

APPARATUS FOR CONTROLLING SPEED OF WORKING MACHINE IN THE FORM OF A CONSTRUCTION MACHINE

TECHNICAL FIELD

The present invention relates to a working machine in the form of a construction machine including booms and a bucket such as a wheel loader, a shovel loader, a dozer shovel or the like and more particularly to a technical idea wherein a tilt speed of the bucket is harmonized with a lift speed of the booms in a case where a scooping operation for scooping gravel or the like is performed by actuating only a bucket operation lever while the booms are automatically lifted by allowing a boom operation lever to be immovably held at a boom kick-out position.

BACKGROUND ART

A construction machine including booms and a bucket such as a wheel loader, a shovel loader or the like has been used in a variety of utilization fields such as construction working site or the like as a working machine from the viewpoint of such advantages that it is constructed in a compact structure, it can turn with a small radius and it can be purchased at an inexpensive cost.

As shown in FIG. 11, this kind of construction machine is so constructed that booms 2 are turned upwardly and downwardly by actuating a boom cylinder 1 (raising of the booms is hereinafter referred to as 'lifting') and a bucket 4 is tilted (turned to a vehicle body side) and caused to dump scooped gravel or the like (reverse operation to tilting) by actuating a bucket cylinder 3. Thus, excavating operation (scooping operation) and loading operation are perfomed for gravel or the like by turning operations of the booms 2 and the bucket 4.

In general, when a scooping operation is performed for gravel, 'lifting' of the booms 2 and 'tilting' of the bucket 4 are alternately repeated. To this end, two methods as noted below are employed as a method of carrying out both the lifting operation and the tilting operation.

(1) An operator alternately actuates a boom operation lever and a bucket operation lever.

(2) In a case where a vehicle is equipped with a boom kick-out device for immovably holding the boom operation lever at a predetermined boom kick-out position, the booms are automatically lifted at a predetermined speed by operating the boom kick-out device. For the lifting operation, operator actuates only the bucket operation lever. Specifically, a bucket preference hydraulic circuit is used for the purpose of driving the working machine so that tilting operation and lifting operation are alternatively repeated by alternately repeating tilting of the bucket operation lever and releasing of the same (representative of shifting of the bucket operation lever to a neutral position).

With respect to the above-mentioned two methods, the second method identified by (2) can be easily practiced compared with the first method identified by (1), because a single operation lever is required therefor. When the second method identified by (2) is employed, a boom kick-out position is usually set to the maximum displacement position, causing an amount of pressurized hydraulic oil fed to the boom cylinder 1 to be maximized during a period of boom lifting as shown in FIG. 12 (periods represented by III and V in FIG. 12). Accordingly, during a period of boom lifting operation as mentioned above, a lift speed of the booms 2 becomes excessively high (to the highest speed) and this makes it very difficult for operator to tilt the bucket in harmonization with the lift speed during a subsequent period of bucket operation.

FIG. 11 illustrates a track B scribed by the blade edge of a bucket in accordance with the conventional method when a scooping operation is performed. In the drawing, reference character W designates an upper surface of gravel and reference character A does a line representing an ideal track. As will be apparent from the drawing, when the conventional method is employed, a tilt speed of the bucket does not follow a lift speed of the booms and therefore the track B scribed by the blade edge of the bucket is not only parted away from the ideal track A but also a period of dumping operation as represented by reference character V is required. Namely, with the conventional method, the lift speed is not harmonized with the tilt speed, resulting in a degree of fullness of the bucket becoming insufficient in the course of scooping operation. In the event of this insufficient fullness, operator actuates the associated lever to turn the bucket to the reverse side to tilting operation so that a shortage in fullness of the bucket is compensated. During a period of dumping operation that may be called useless period, a bucket vertical load $F_V$ is reduced as shown in FIG. 13, causing a slippage to be induced with fore wheel tires during the period V. Consequently, excavating operation can not be performed at a high operational efficiency.

The present invention has been made with the foregoing background in mind and its object resides in providing an apparatus for controlling a speed of a working machine in the form of a construction machine which assures that a bucket moves along an ideal track by allowing a lift speed of the booms to be harmonized with a tilt speed of the bucket and an occurrence of tire slippage requiring useless dumping is prevented.

DISCLOSURE OF THE INVENTION

To accomplish the above object, the present invention provides an apparatus for controlling a speed of a working machine in the form of a construction machine, wherein it comprises a boom operation lever having a lever holding function of holding the boom operation lever at a predetermined boom kick-out position to generate a boom operation signal corresponding to a lever position, a bucket operation lever adapted to generate a bucket operation signal corresponding to the lever position, boom driving means for driving booms so as to allow the booms to be lifted and lowered, bucket driving means for driving a bucket so as to allow the latter to be tilted to dump scooped gravel or the like, bucket angular speed detecting means for detecting a bucket angular speed during a period in which the bucket operation lever is displaced to the tilt side, calculating means for calculating a lift control signal on the basis of a value detected by the bucket angular speed detecting means during a previous period of tilting operation, the lift control signal corresponding to the detected value during a period in which the bucket operation lever is returned to a neutral position, and controlling means for introducing into the bucket driving means a signal corresponding to a bucket holding signal of the bucket operation lever and introducing into the boom driving means a lift control signal calculated by the calculating means, when the boom operation lever is held at a boom kick-out position.

With such construction, since the booms are lifted at a speed corresponding to the lift speed during the previous period of tilting operation while the bucket operation lever is turned to the neutral position, it follows that the lift speed is harmonized with the tilt speed and thereby a track scribed by the blade edge of the bucket approaches very near to an ideal track. In addition, since an useless operation such as dumping operation performed by the tilt operation lever is not required, an operational efficiency can be improved substantially. Another advantageous effects are that a bucket vertical load is reduced and no slippage is induced with fore wheel tires because no dumping operation is required as mentioned above.

Further, according to other aspect of the present invention, an apparatus for controlling a speed of a working machine in the form of a construction machine comprises a boom operation lever having a lever holding function of holding the boom operation lever at a predetermined boom kick-out position, a bucket operation lever adapted to generate a bucket operation signal corresponding to a lever position, boom driving means for driving booms to lift and lower the latter, bucket driving means for driving a bucket to tilt the latter and allow scooped gravel or the like to be dumped, boom angle detecting means for detecting a boom angle, calculating means for calculating a lift control signal corresponding to a value detected by the boom angle detecting means, the lift control signal corresponding to the detected value during a period in which the bucket operation lever is turned to the neutral position, and controlling means for introducing into the bucket driving means a signal corresponding to the bucket operation signal of the bucket operation lever and introducing into the boom driving means a lift control signal calculated by the calculating means, when the boom operation lever is held at a boom kick-out position.

With such construction, since the booms are lifted at a speed corresponding to a boom angle (boom height) during a period of lifting operation, a track scribed by the blade edge of the bucket becomes ideal and thereby the same advantageous effects as those of the apparatus according to the preceding aspect of the present invention can be obtained.

BEST MODE FOR CARRYING OUT THE INVENTION

Now, the present invention will be described in a greater detail hereunder with reference to the accompanying drawings which illustrate preferred embodiments thereof.

Figure 2:
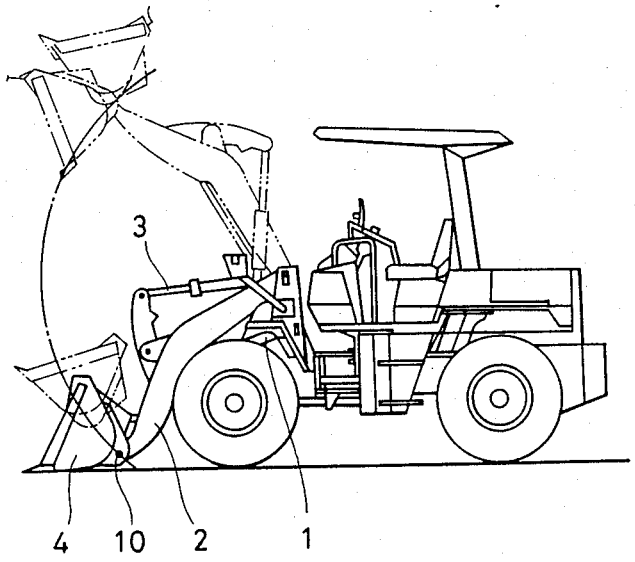
FIG. 2 is an outside view illustrating a wheel loader.

FIG. 2 is an outside view showing an example of a working machine in the form of a wheel loader to which the present invention is applied. The wheel loader includes two boom cylinders 1, boom 2, a bucket cylinder 3 and a bucket 4. A bucket angle sensor 10 is attached to the turning portion of the bucket 4 to detect a bucket angle $\theta$.

Figure 1:
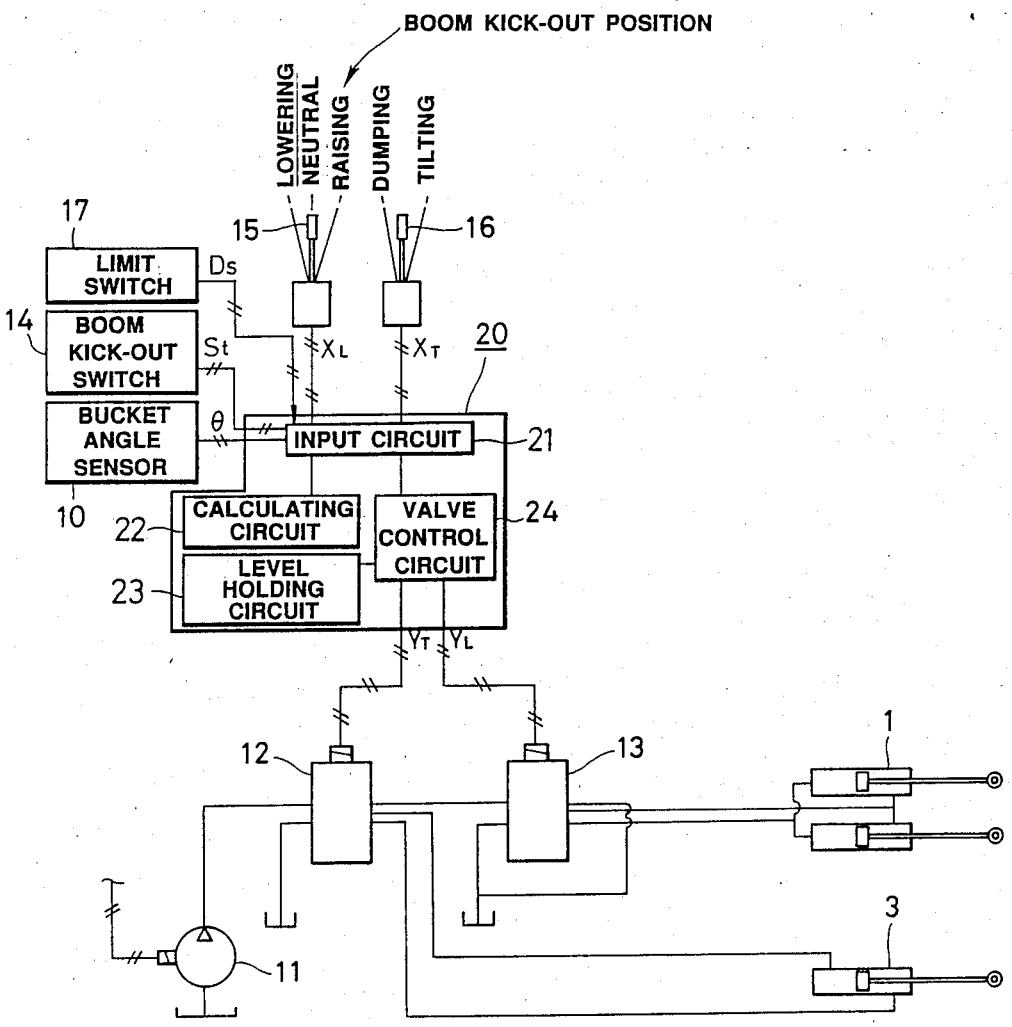
FIG. 1 is a block circuit diagram illustrating an apparatus for controlling a speed of a working machine in accordance with an embodiment of the present invention.

FIG. 1 shows by way of example a control system for driving the boom cylinders 1 and the bucket cylinder 3 wherein a value $\theta$ detected by the bucket angle sensor 10 is inputted into a controller 20. A limit switch 17 is intended to detect a fact that the booms 2 are raised up to a predetermined height. When the booms 2 have been raised up to the predetermined height, a detected signal $D_S$ is inputted into the controller 20.

A boom operation lever 15 and a bucket operation lever 16 are electric type levers adapted to output voltages $X_L$ and $X_T$ corresponding to displacements of the levers 15 and 16. The boom operation lever 15 is provided with a lever fixing device (not shown) which serves to immovably hold the lever 15 at a kick-out position. A boom kick-out switch 14 is turned on when the boom operation lever 15 is held at the kick-out position so as to allow a boom kick-out signal $S_T$ to be outputted therefrom.

The boom cylinder 1 and the bucket cylinder 2 are controlled by means of a boom control valve 13 and a bucket control valve 12 for shifting their operation mode as required. The boom control valve 13 and the bucket control valve 12 are an electromagnet type proportion control valve respectively adapted to produce a flow rate in proportion to an electric signal outputted from the controller 20. In the illustrated case, the valves 12 and 13 constitute a bucket preference hydraulic circuit.

Specifically, pressurized hydraulic oil delivered from a hydraulic pump 11 is fed to the bucket cylinder 3 and the boom cylinder 1 via the bucket control valve 12 and the boom control valve 13 in order to preferentially drive the bucket 4 when a spool in the bucket control valve 12 assumes a tilt position or a dump position or drive the boom cylinder 1 by actuation of the boom control valve 13 when the bucket control valve 12 is located at a neutral position.

The controller 20 includes a calculating circuit 22, a level holding circuit 23 and a valve control circuit 24 in addition to the input circuit 21 into which a bucket angle signal $\theta$, a detected signal $S_T$ from the boom kick-out switch 14, a detected signal $D_S$ from the limit switch 17 and lever signals $X_L$ and $X_T$ from the boom operation lever 15 and the bucket operation lever 16 are inputted.

Figure 3:
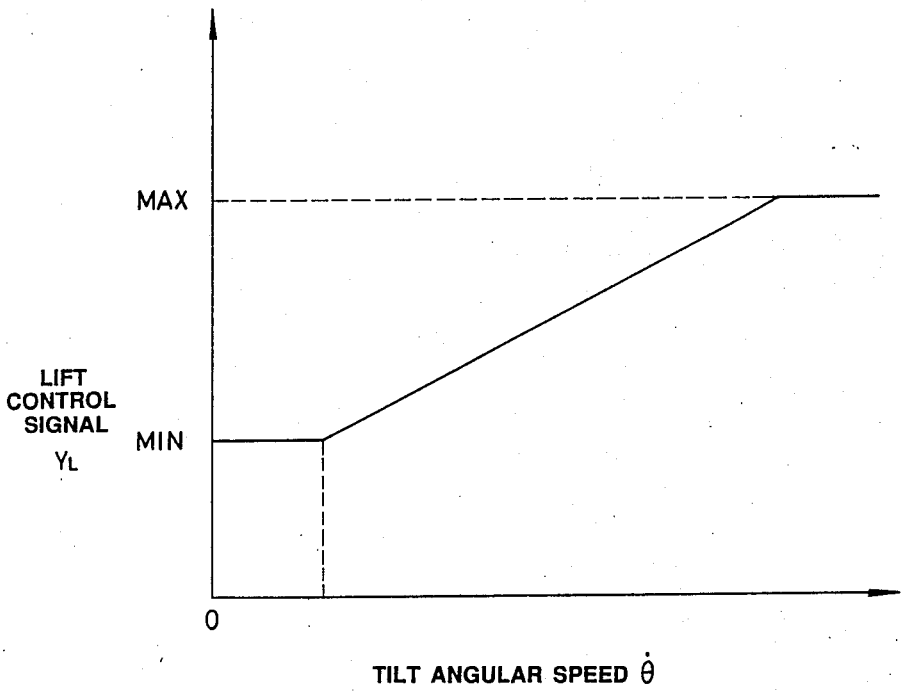
FIG. 3 is a graph illustrating a relationship of a lift control signal relative to a tilt angular speed.

The calculating circuit 22 calculates a bucket angular speed $\dot{\theta}$ during a tilt period in which the bucket operation lever 16 performs tilt operation and then calculates a lift output signal $Y_L$ to be outputted during a next lift period on the basis of the calculated value $\dot{\theta}$. Specifically, the calculating circuit 22 has a table stored therein corresponding to the tilt angular speed $\dot{\theta}$ and the lift output signal $Y_L$ as shown in FIG. 3 or has a calculating formula set and stored therein corresponding to the above-mentioned corresponding table. The calculating circuit 22 derives a bucket angular speed $\dot{\theta}$ ($=\Delta O/\Delta T$) on the basis of a tilt period $\Delta T$ from the time when the bucket operation lever 16 is displaced to its tilt position to the time when it is returned to its neutral position as well as an amount $\Delta\theta$ of variation in bucket angle $\theta$ during the tilt period $\Delta T$ and it further converts the calculated value $\theta$ into a lift control signal $Y_L$ corresponding to the calculated value $\dot{\theta}$ using the above-mentioned corresponding table or a conversion formula. Consequently, the above-mentioned calculated value $\dot{\theta}$ becomes an average value of the bucket angular speed during a period of tilting operation. Incidentally, the kind of gravel to be excavated, the kind of ground surface, a degree of gradient, an extent of opening of an engine throttle valve, a degree of skillfulness of an operator, a frequency of shifting of tilting operation to lifting operation and vice versa or the like can be noted as a factor of varying the bucket angular speed $\dot{\theta}$.

The level holding circuit 23 is intended to maintain the lift control signal $Y_L$ calculated in the calculating circuit 22 at the current level for a predetermined period of time t during a period of boom lifting operation in which the boom operation lever 15 is held at the boom kick-out position and the bucket operation lever 16 is held at the neutral position. When it is found that the bucket operation lever 16 has not moved from the neutral position even after the predetermined period of time t has elapsed, a level of the lift output signal $Y_L$ is raised up to the maximum value corresponding to the maximum flow rate of hydraulic oil delivered from the pump. The period of time t is set to some extent longer than a period corresponding to one tilting operation to be performed by operator for a normal work. The valve control circuit 24 is intended to convert the lever signal $X_T$ inputted from the bucket operation lever 16 via the input circuit 21 into a tilt control signal $Y_T$ corresponding to a level of the lever signal $X_T$ and then input the tilt control signal $Y_T$ into the bucket control valve 12 while the the lift control signal $Y_L$ inputted from the level holding circuit 23 is outputted to the boom control valve 13. It should be noted that the above-mentioned operations of the calculating circuit 22 and the level holding circuit 23 are performed only when the boom kick-out function with which the boom operation lever 15 is held at the boom kick-out position is executed and when a normal boom operation is performed, the lever signal $X_L$ outputted from the boom operation lever 15 is converted into a lift control signal $Y_L$ as it is and thereafter the converted lift control signal $Y_L$ is outputted therefrom.

Next, functions of the apparatus as constructed in the above-described manner will be described below with reference to a flowchart shown in FIG. 4.

Figure 6:
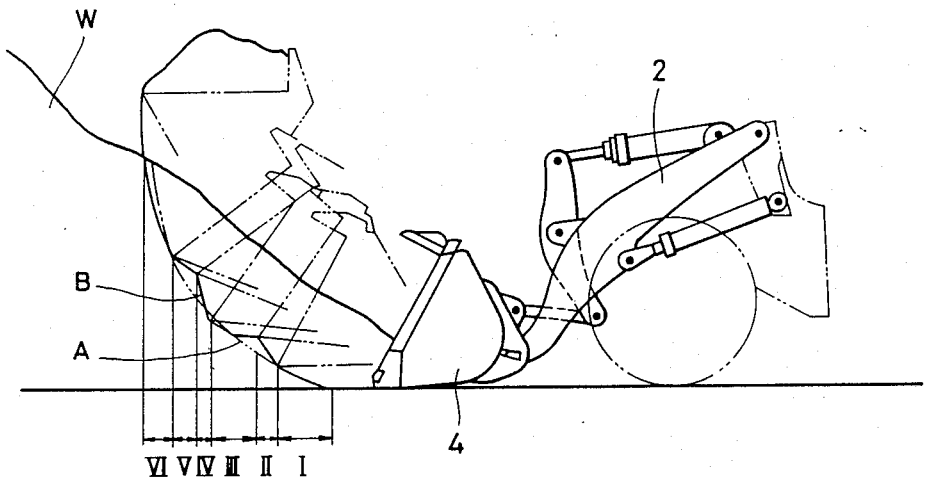
FIG. 6 is a view illustrating by way example a track scribed by excavating operation of the machine in accordance with the embodiment.

When a scooping operation is performed, an operator causes the vehicle to move forwardly while maintaining the bottom of the bucket 4 in the generally horizontal direction with the booms 2 being lowered as represented by solid lines in FIG. 6 whereby the bucket 4 is plunged into a mass of gravel W. In the course of forward movement of the vehicle, operator displaces the boom operation lever 15 to the boom kick-out position which is then settled by him.

When the calculating circuit 22 in the controller 20 determines that the boom operation lever 15 has been held at the boom kick-out position in response to a kick-out starting signal $S_T$ outputted from the boom kick-out switch 14 (step 100), a bucket tilt angular speed $\dot{\theta}$ to be later calculated in the calculating circuit 22 is initially set to zero (step 110). Next, at a step 130, the controller 20 determines whether the bucket operation lever 16 is actuated or not. Since the bucket operation lever 16 is held still at the neutral position when the first plunging operation has been performed, decision made at the step 130 is represented by NO and then the process goes to a step 170.

At the step 170, the controller 20 determines the tilt angular speed $\dot{\theta}$ calculated in the calculating circuit 22 is zero or not. When the first plunging operation is performed, the value $\dot{\theta}$ is kept as set to an initial value of zero at the step 110 and therefore the decision is represented by YES. Then, at a step 180, the controller 22 allows the maximum control signal $Y_L$ corresponding to the lever position assumed by the boom operation lever 15, that is, the boom kick-out position to be inputted into the boom control valve 13. As represented by a period I in FIG. 5, pressurized hydraulic oil is fed from the pump to the boom cylinder 1 at the maximum flow rate immediately after a boom kick-out is initiated whereby the booms 2 are lifted at the highest speed.

Incidentally, when the decision made at the step 100 is represented by NO, the controller 20 allows the lift control signal $Y_L$ and the tilt control signal $Y_T$ corresponding to displacements of the respective operation levers 15 and 16 to be outputted to the respective control valves 13 and 12 as they are, as mentioned previously (setp 120).

Figure 13:
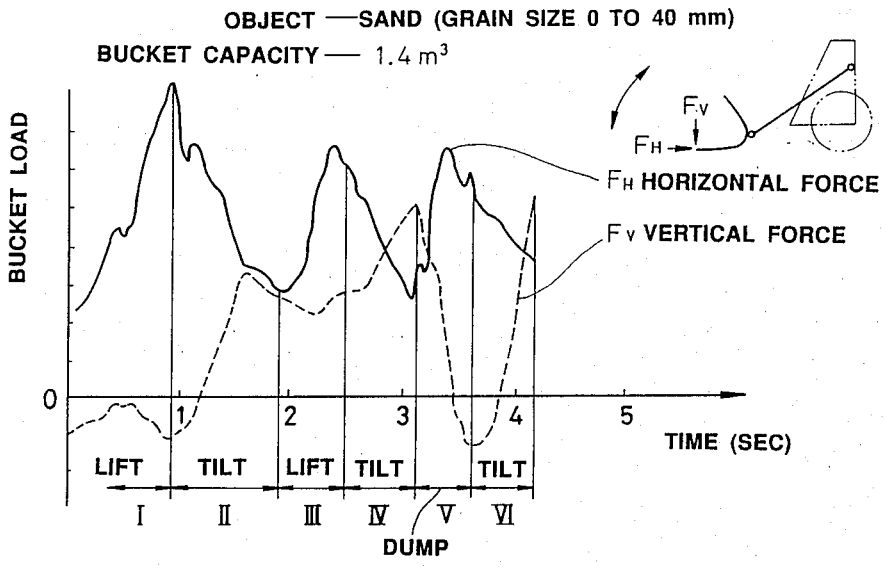

While the bucket 4 performs plunging operation accompanied by such lift movement of the booms 2 (period I, FIG. 5), a horizontal resistant force $F_H$ against the bucket 4 (see FIG. 13) increases so that plunging of the bucket 4, that is, forward movement of the vehicle can be hardly achieved. To eliminate the undesirable operative state, operator displaces the bucket operation lever 16 to the tilt side by a properly determined distance so the bucket 4 is tilted (period II, FIG. 5).

At the step 130, tilting operation performed by operator is detected by the controller 20. Then, the controller 20 converts the lever signal $X_T$ inputted from the bucket operation lever 16 into a tilt control signal $Y_T$ in the valve control circuit 24 and the signal $Y_T$ is then outputted to the bucket control valve 12 (steps 140 and 150). This permits the bucket 4 to be tilted at a speed corresponding to a displacement of the operation lever 16. As tilting operation is performed in this way, the controller 20 causes a value $\dot{\theta}$ detected by the bucket angle sensor 10 to be inputted thereinto so that an average tilt angular speed $\dot{\theta}$ of the bucket 4 during the period II is calculated in the calculating circuit 22 (step 160). Specifically, an amount $\Delta\theta$ of variation in bucket angle ($=\theta_2-\theta_1$) during the tilt period II is derived by obtaining a difference between a bucket angle $\theta_1$ at the beginning of tilting operation and a bucket angle $\theta_2$ at the time when the tilting operation is released and an average tilt angular speed $\dot{\theta}$ ($=\Delta\theta/\Delta T$) during the tilt period II is derived by deviding the amount $\Delta\theta$ of variation in bucket angle by a period of tilt time $\Delta T$ from the beginning of tilting operation to completion of the same (in other words, period of time that elapses from displacement of the bucket operation lever 16 to the tilt position to displacement of the same to the neutral position) so that the value $\theta$ initially set at the step 110 is updated using the value $\dot{\theta}$ derived in the above-described manner.

When operator determines in the course of tilting operation that an amount of gravel scooped by the bucket 4 is insufficient, he returns the tilt operation lever 15 from the tilt position to the neutral position whereby tilting operation is released.

Releasing of the tilting operation is detected by the controller 20 at the step 130. Next, when releasing of the tilting operation is detected, the controller 20 determines at a step 170 whether the tilt angular speed $\dot{\theta}$ assumes O or not. In the illustrated case, since tilting operation is performed during the period II, the result is represented by $\theta \neq O$ and the decision made at the step 170 becomes O. Accordingly, the calculating circuit 22 in the controller 20 calculates a lift control signal $Y_L$ corresponding to the average tilt angular speed $\dot{\theta}$ previously calculated during the tilt period II with reference to the corresponding table in FIG. 3 and the lift control signal $Y_L$ is outputted to the boom control valve via the level holding circuit 23 and the valve control circuit 24 (step 190). By doing so, the booms 2 are lifted at a speed matched to the tilt speed during the previous period II (period III in FIG. 5). Incidentally, during the lift period III, the level holding circuit 23 is activated to keep the lift control signal $Y_L$ to a level calculated at the beginning of the lift control signal $Y_L$ until a predetermined period of time t elapses after the tilting operation is released (step 200).

Figure 5:
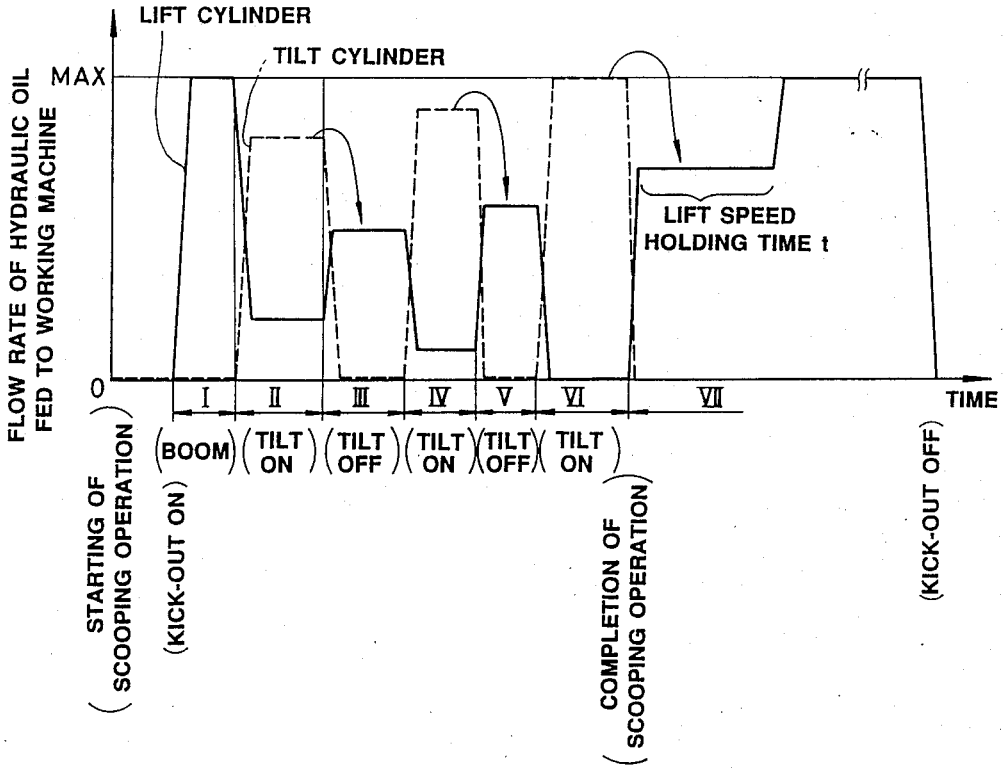
FIG. 5 is a graph illustrating variation in amount of hydraulic oil fed to the respective cylinders as time elapses during a scooping operation performed by the machine in accordance with the embodiment.

Thereafter, when it is found that an extent of plunging of the bucket is insufficient, operator displaces the bucket operation lever 16 to the tilt side by a properly determined distance again so that the bucket 4 is tilted in the same manner as during the period II (steps 130 to 150, period IV in FIG. 5). An average tilt angular speed $\theta$ also during the period IV is calculated in the calculating circuit 22 in the same manner as mentioned above (step 150).

When operator displaces the bucket operation lever 16 again to release tilting operation, a lift control signal $Y_L$ corresponding to the average tilt angular speed $\dot{\theta}$ during the previous tilt period IV is derived from the corresponding table in the same manner as mentioned above and thereby lifting operation of the booms 2 is controlled in accordance with the control signal $Y_L$ (steps 130, 170, 190 and 200, period V in FIG. 5).

Hereinafter, the aforementioned control operations are likewise repeated. It should be noted that in the case shown in FIG. 5, at the time point when tilting operation during a period VI is completed, that is, at the time point when tilting operation is released, opetrator determines that scooping operation during the period VI has been completed and thereafter no tilting operation is performed any longer. Thus, during a period VII of boom lifting operation, the lift control signal $Y_L$ is kept at a level corresponding to the average tilt angular speed $\dot{\theta}$ during the previous period VI of tilting operation by the level holding circuit 23, until a predetermined period of time t elapses. In this case, however, since the bucket operation lever 16 is kept immovable from the neutral position even after the period of time t elapses, the lift control signal $Y_L$ is raised up by means of the level holding circuit 23 to the maximum value corresponding to the maximum flow rate of hydraulic oil discharged from the pump after the period of time t elapses (step 210). Accordingly, the booms 2 are lifted at a speed harmonized with the previous average tilt angular speed $\dot{\theta}$ until the aforesaid period of time t elapses but they are lifted at the highest speed after it has elapsed. Thereafter, when the booms 2 are lifted up to a predetermined height at which the limit switch 14 is disposed, this is detected by the boom kick-out switch 14 and a detected signal $D_S$ is then inputted to the controller 20. This causes a boom lever fixing device which is not shown in the drawings to be released by the controller 20 whereby the boom operation lever 15 is automatically returned from the boom kick-out position to the neutral position. On completion of the aforementioned process, a single scooping operation is over.

In this manner, according to the foregoing embodiment, a boom lift speed is variable corresponding to the average bucket angular speed during the previous period of tilting operation (but remains unchanged during a period of one lifting operation). Thus, an amount of hydraulic oil to be fed to the boom cylinder 1 during a period of scooping operation can be reduced compared with the prior art (see FIG. 10), as represented by the periods III, V and VII in FIG. 5 and moreover a lift speed can be harmonized with a tilt speed.

Figure 11:
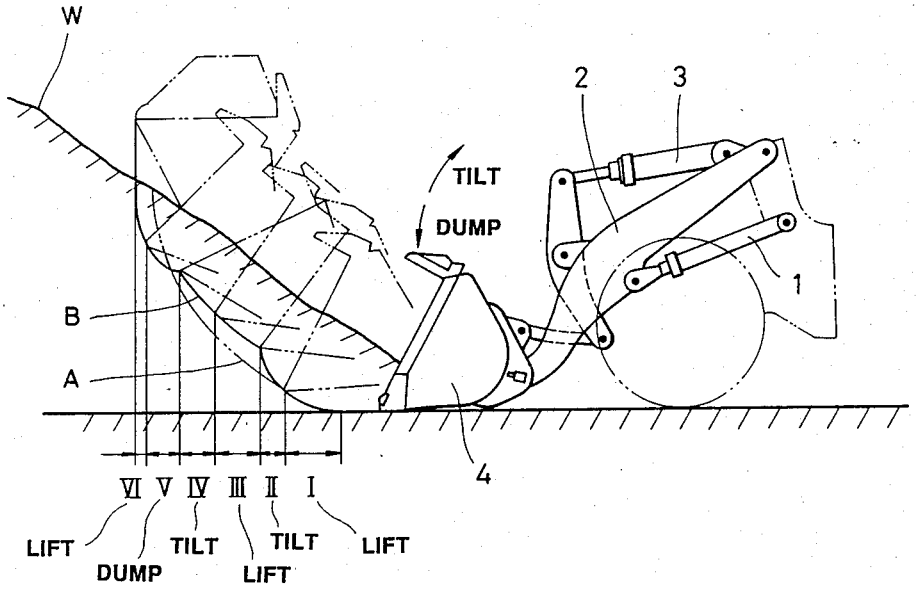
FIG. 11 is a view illustrating by way of example a track scribed by excavating operation of a conventional apparatus.
Figure 12:
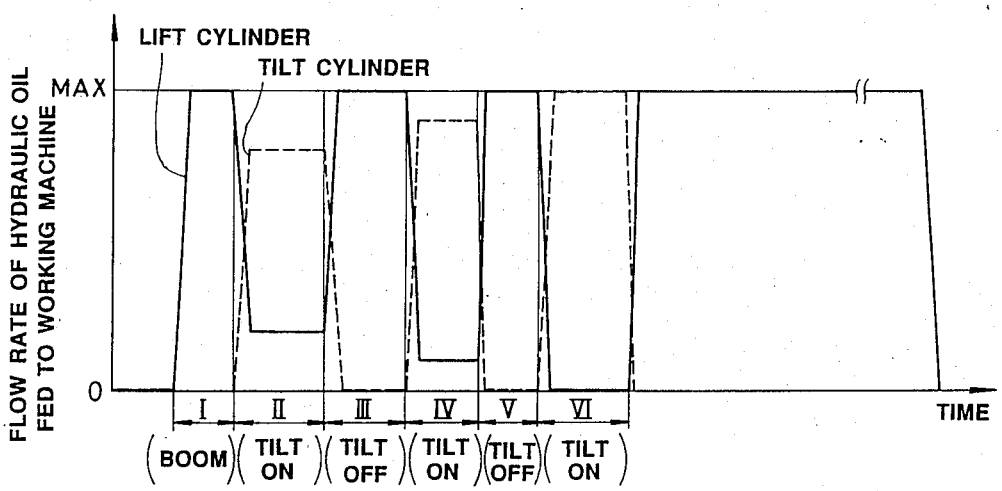
FIG. 12 is a graph illustrating a variation in amount of hydraulic oil fed to the respective cylinders during a scooping operation performed by the conventional apparatus and FIG. 13 is a graph illustrating a variation in horizontal resistance and vertical resistance as time elapses during a scooping operation performed by the conventional apparatus.

In this manner, a lift speed matched to a tilt speed can be obtained even in a case where an easy operation is performed merely by actuating the bucket operation lever with the aid of a boom kick-out function and thereby the direction of plunging of the bucket 4 into a mass of gravel is oriented toward a higher level of efficiency of scooping operation to assume a track scribed by the blade edge of the bucket as represented by reference character B in FIG. 6 which is very near to an ideal track A. Consequently, an operational efficiency can be improved and there is no need of performing a dump operation as represented by the period V in FIG. 11 which is indicative of that of the prior art, resulting in no slippage being induced by such a dump operation.

Figure 4:
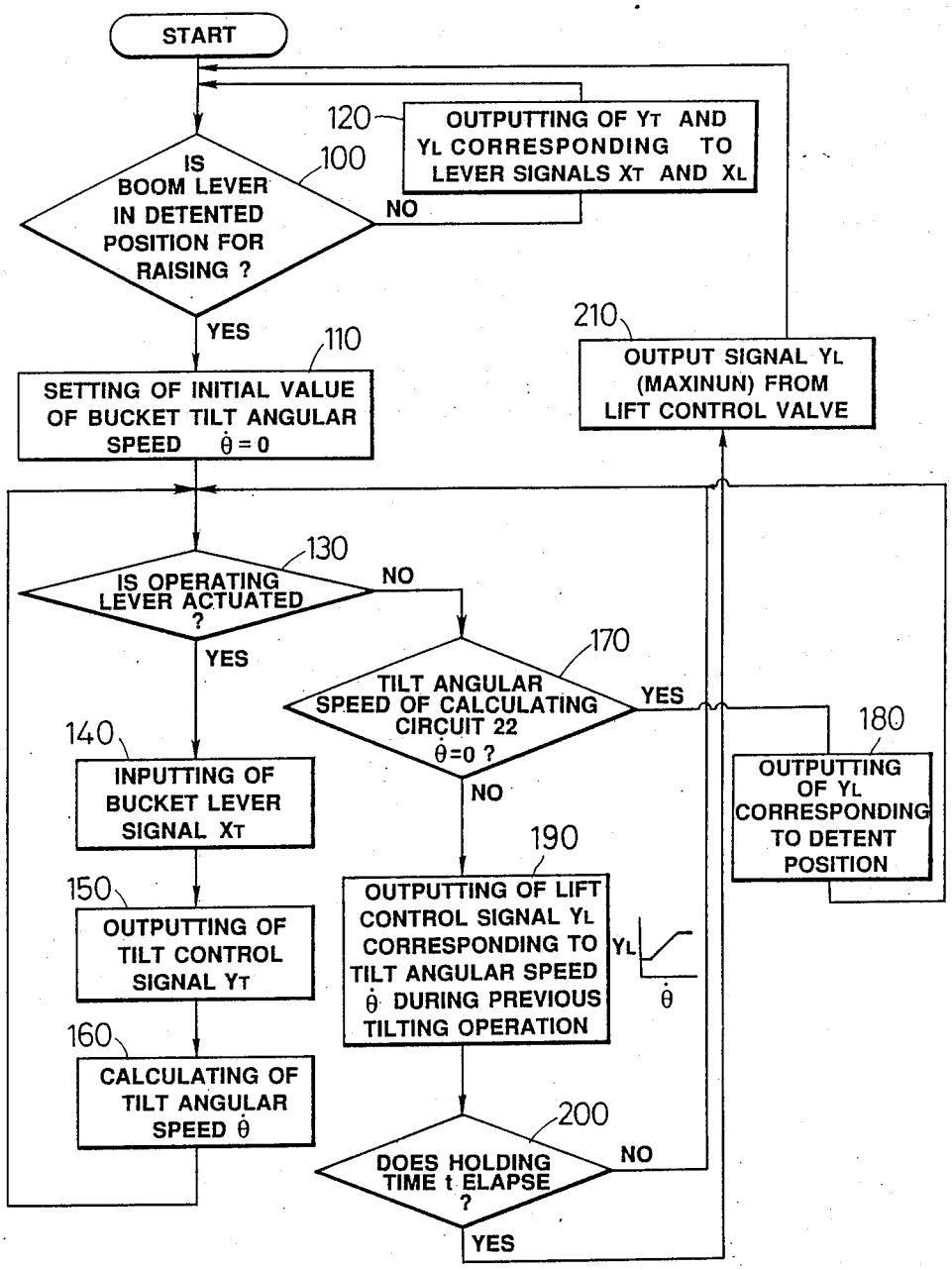
FIG. 4 is a flowchart illustrating by way of example operations of the apparatus in accordance with the embodiment.

Incidentally, in the foregoing embodiment, the initial setting of $\theta$ executed at the step 110 in FIG. 4 is provided to discriminate the lift period (period I in FIG. 5) just before the first tilt period (period II in FIG. 5). However, the present invention should not be limited only to this. Alternatively, the step 110 may be eliminated so that a lifting operation starts from the time point when the first tilt period is completed.

Further, in the foregoing embodiment, the bucket angular speed $\dot{\theta}$ ($=\Delta\theta/\Delta T$, consequently, average angular speed) during the tilt period $\Delta T$ is derived by obtaining an angular displacement $\Delta\theta$ of the bucket angle $\theta$ and a tilt period $\Delta T$. Alternatively, an average value $\bar{\dot{\theta}}$ ($=\Sigma\dot{\theta}/n$) of the bucket angular speed during the tilt period may be derived by disposing an angular speed meter and calculating an average value among values detected by the angular speed meter.

Figure 7:
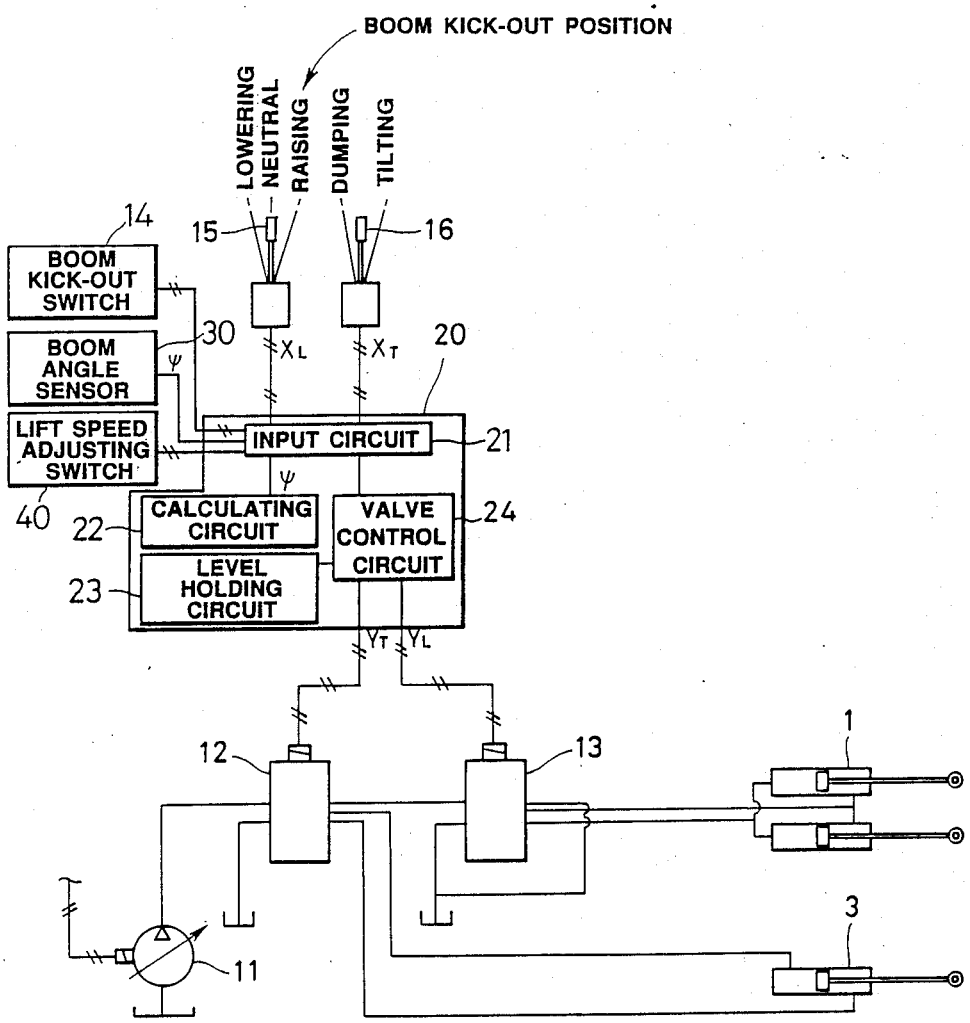
FIG. 7 is a block circuit diagram illustrating an apparatus in accordance with other embodiment of the present invention.

FIG. 7 illustrate other embodiment of the present invention.

Figure 8:
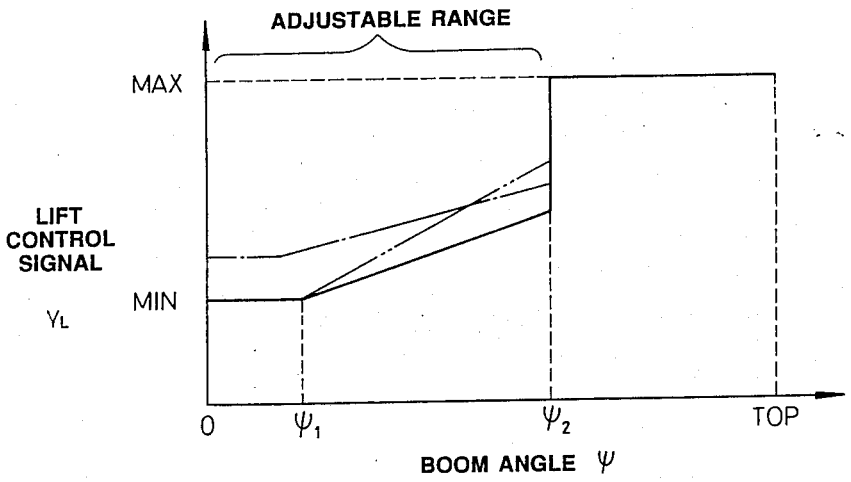
FIG. 8 is a graph illustrating a relationship of a lift control signal relative to a boom angle.

In this embodiment, a boom angle sensor 30 is disposed in place of the bucket angle sensor 10 in the preceding embodiment so that a lift speed can be changed in dependence on a boom angle $\psi$ on completion of a tilting operation. To this end, a calculating circuit 22 in a controller 20 has a corresponding table stored therein which is repsentative of a relationship between a boom angle $\psi$ and a lift control signal L as shown in FIG. 8. Specifically, as is apparent from the table, $Y_L$ is maintained at the lowest level till an angle $\psi_1$, $Y_L$ gradually increases in a region between angle $\psi_1$ and angle $\psi_2$ and $Y_L$ is raised up to the highest level in a region more than angle $\psi_2$ as represented by solid lines, and a linear line level, an inclination and a curve or the like shape shown by dot and dash line and phantom line in the region between angle O and angle $\psi_2$ can be arbitrarily changed by actuating a lift speed adjusting switch 40 shown in FIG. 7.

Figure 9:
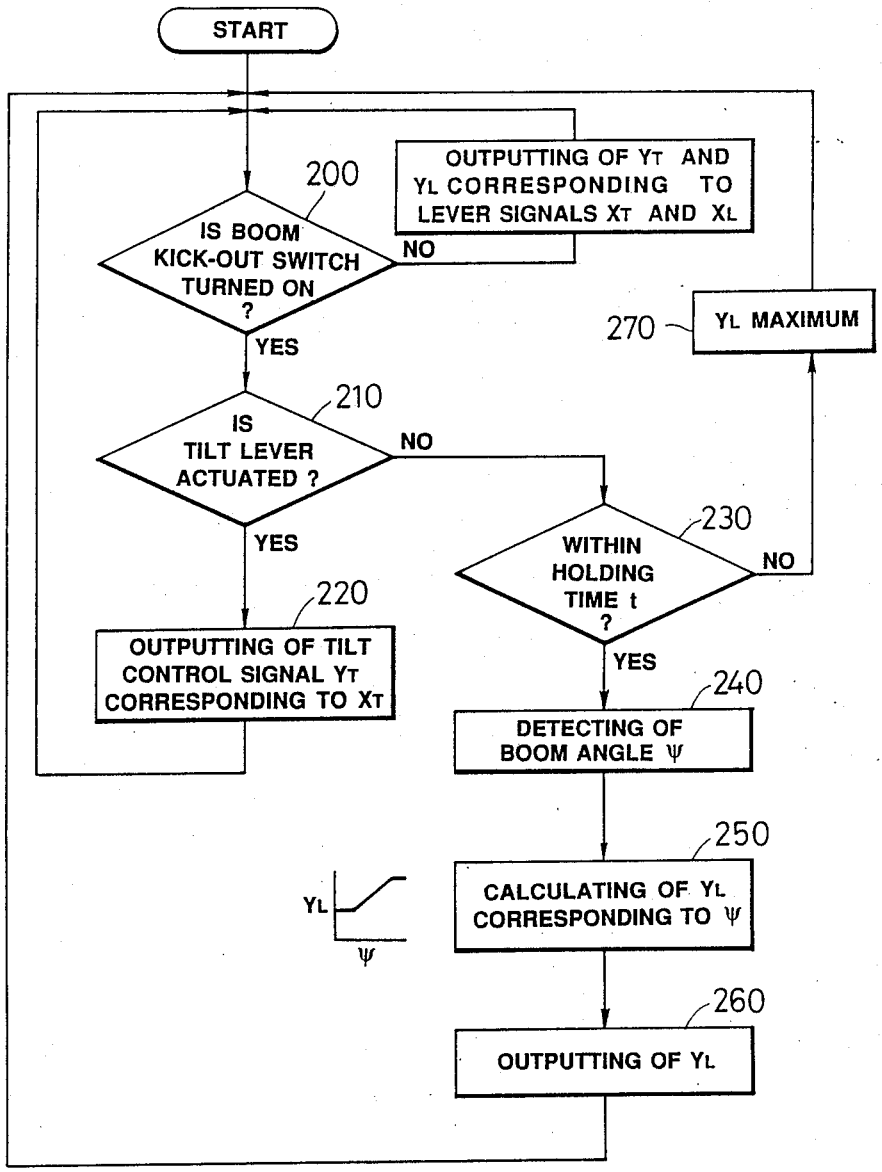
FIG. 9 is a flowchart illustrating by way of example operations of the apparatus in accordance with the other embodiment.

Next, function of the apparatus in accordance with this embodiment will be described below with reference to FIG. 9 which shows a flowchart and FIG. 10.

When the controller 20 detects that a boom kick-out switch 14 is shifted to ON (step 200), it determines whether a bucket operation lever 16 is actuated to a tilt position or not (step 210). When it is found that a decision made at the step 210 is YES, this represents that a tilting operation shown by periods II, IV and VI is performed. During these periods, the controller 20 outputs to a bucket control valve 12 a tilt control signal $Y_T$ corresponding to a lever signal $X_T$ outputted from the bucket operation lever 16 (step 220). As a result, during the periods II, IV and VI, a bucket 4 is tilted at a speed corresponding to a displacement of the operation lever and booms 2 are lifted using the residual pressurized hydraulic oil.

Figure 10:
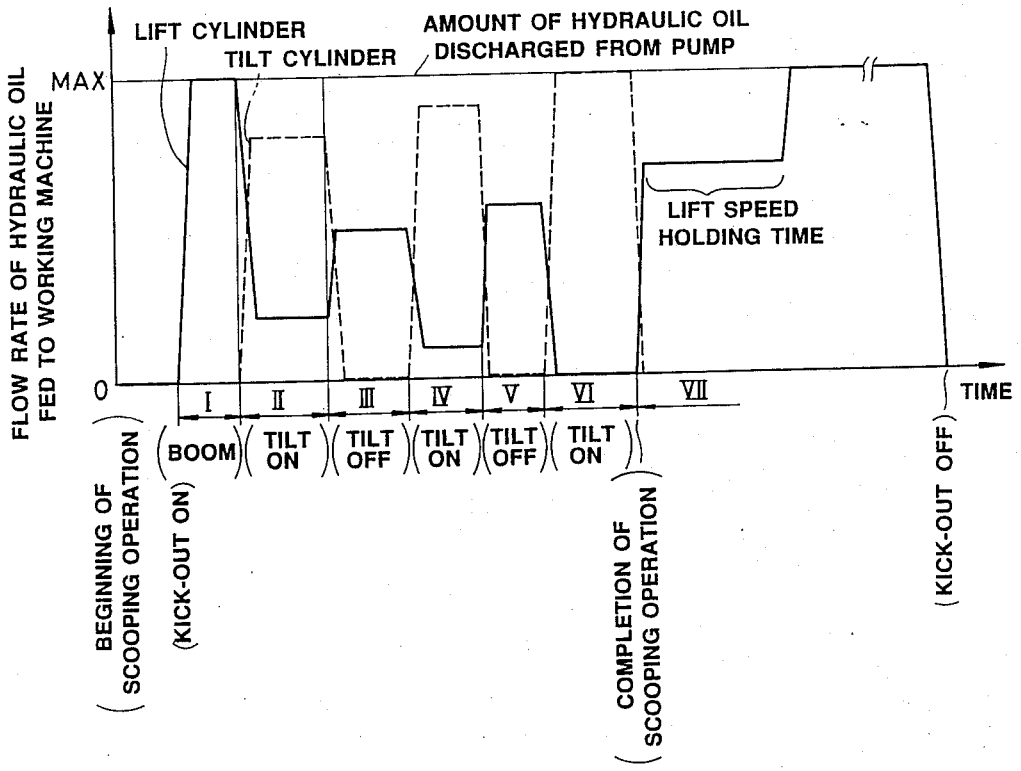
FIG. 10 is a graph illustrating by way of example a variation in amount of hydraulic oil fed to the respective cylinders during a scooping operation of the apparatus in accordance with the other embodiment.

In addition, when it is found that the decision made at a step 210 is NO, this represents a period in which the booms are lifted, as shown by periods I, III, V and VII in FIG. 10. Although a process representing the boom lifting operation is neglected in the flowchart in FIG. 9, the boom 2 are lifted at the highest speed during the period I in accordance with the process shown in the preceding process.

At the time point when the periods III, V and VII start, that is, when the bucket operation lever 16 is returned from the tilt position to the neutral position, the calculating circuit 22 in the controller 20 receives therein a value $\psi$ detected by the boom angle sensor 30 at this moment (step 240), it converts the detected value $\psi$ into a lift control signal $Y_L$ corresponding to the detected value $\psi$ using the corresponding table in FIG. 8 (step 250) and it outputtes the lift control signal $Y_L$ to a control valve 13 via a level holding circuit 23 and a valve control circuit 24 (step 260). This permits the booms 2 to be lifted at a speed corresponding to the boom height at the beginning of lift starting during the boom lift period identified by the periods III, V and IIV. Particularly, in a case where the corresponding table shown in FIG. 8 is used, the booms are lifted at a higher speed as the boom height is increased more and more, in other words, as a scooping operation proceeds further.

Incidentally, in a case where no tilting operation is performed during a period of time t, the input signal is maintained at the current level during the predetermined period of time t and only in a case where no bucket operation is performed even after the predetermined period of time t elapses, the level holding circuit 23 is activated to raise a level of the signal $Y_L$ up to the highest one in the same manner as in the preceding embodiment (steps 230, 270, rear half of period VII in FIG. 10).

In this manner, according to this embodiment, a lift speed of the booms is variable in dependence on a boom angle (boom height) at the time when tilting operation is released (but it remains unchanged during a period of one lifting operation) and moreover it becomes higher as the boom height is increases more and more. Thus, an amount of hydraulic oil fed to the boom cylinder 1 during a period of scooping operation can be reduced compared with the prior art, as represented by the periods III, V and VII in FIG. 10. In addition, the direction of plunging of the bucket 4 is shifted to a direction having a higher efficiency of scooping operation whereby a track scribed by the blade edge of the bucket can approach very near to an ideal track. When the boom angle exceeds an angle ($\psi_2$ in FIG. 8) during a period of scooping operation or when a period of time t set in the level holding circuit 23 elapses after completion of the tilting operation, the lift speed can be increased at the highest rate in the same manner as the conventional apparatus. Therefore, there is no fear that an operational efficiency is reduced compared with the conventional apparatus. Further, since no dumping operation is required, any tire slippage is not induced.

INDUSTRIAL APPLICABILITY

The present invention is advantageously applicable to a construction machine including booms and a bucket as a working machine such as a wheel loader, a shovel loader, a dozer shovel or the like machine adapted to perform a scooping operation while allowing a vehicle to move toward a mass of gravel or the like.

We claim:

1. An apparatus for controlling a speed of a working machine in the form of a construction machine including booms and a bucket to alternately repeating a lifting operation with said booms and a tilting operation with said bucket, said apparatus comprising;

a boom operation lever having a lever holding function for holding said boom operation lever at a predetermined boom kick-out position to generate a boom operation signal corresponding to said boom kick-out position, a bucket operation lever adapted to generate a bucket operation signal corresponding to said bucket lever position, boom driving means for driving said booms to lift and lower the latter, bucket driving means for driving said bucket to tilt the latter and allow the same to dump scooped gravel or the like, bucket angular speed detecting means for detecting a bucket angular speed during a period in which said bucket operation lever is displaced to the tilting operation side and back to a neutral position, calculating means for calculating a lift control signal on the basis of a detected value detected by said bucket angular speed detecting means during a preceding bucket tilt period, said lift control signal corresponding to said detected value during a period in which said bucket operation lever is returned to said neutral position, and controlling means for introducing into said bucket driving means a signal corresponding to a bucket operation signal of said bucket operation lever and introducing into said boom driving means a lift control signal calculated in said calculating means, when said bucket operation lever is in said neutral position and said boom operation lever is maintained at said boom kick-out position.

2. An apparatus for controlling a speed of a working machine in the form of a construction machine as claimed in claim 1, wherein said bucket angular speed detecting means detects an average value during a period in which said bucket operation lever is displaced to the tilting operation side.

3. An apparatus for controlling a speed of a working machine in the form of a construction machine as claimed in claim 1, wherein said bucket angular speed detecting meams includes bucket angle detecting means for detecting a bucket angle and average value calculating means for obtaining an amount of variation in bucket angle during said period using an output from said bucket angle detecting means, dividing said amount of variation by a time which elapses during said period and then outputting the divided value as an average value of said bucket angular speed.

4. An apparatus for controlling a speed of a working machine in the form of a construction machine as claimed in claim 1, wherein said calculating means including a storage table for storing said bucket angular speed and a lift control signal corresponding to said bucket angular speed under a condition of the correspondence of said bucket angular speed to said lift control signal whereby said bucket angular speed is converted into said lift control signal by means of said storage table.

5. An apparatus for controlling a speed of a working machine in the form of a construction machine as claimed in claim 4, wherein said storage table is such that said lift control signal is increased as a tilt angular speed is increased.

6. An apparatus for controlling a speed of a working machine in the form of a construction machine as claimed in claim 5, wherein said storage table is such that said lift angular speed is maintained at the lowest level when said tilt angular speed is less than a predetermined speed and said tilt angular speed and said lift control speed are maintained in a proportional relationship when said tilt angular speed is more than said predetermined speed.

7. An apparatus for controlling a speed of a working machine in the form of a construction machine as claimed in claim 1, wherein said calculating means includes level holding means for holding a calculated lift control signal at a level calculated during a predetermined period of time and raising said lift control signal up to the maximum level when said predetermined period of time elapses.

8. An apparatus for controlling a speed of a working machine in the form of a construction machine as claimed in claim 1, wherein said boom driving means and said bucket driving means are provided with a bucket preference hydraulic circuit, a boom cylinder and a bucket cylinder.

* * * * *